US005295318A

United States Patent [19]

Schaeff

[11] Patent Number: 5,295,318

[45] Date of Patent: Mar. 22, 1994

[54] BACKHOE-LOADER

[75] Inventor: Hans Schaeff, Langenburg, Fed. Rep. of Germany

[73] Assignee: Karl Schaeff GmbH & Co., Langenburg, Fed. Rep. of Germany

[21] Appl. No.: 916,435

[22] Filed: Jul. 21, 1992

[30] Foreign Application Priority Data

Jul. 24, 1991 [DE] Fed. Rep. of Germany ..... 4124461

[51] Int. Cl.[5] ..... E02F 3/76

[52] U.S. Cl. ..... 37/379; 37/410; 37/403; 37/443

[58] Field of Search ..... 37/103, 118 R, 80 R, 37/1, 379, 403, 410, 443, 411, 347, 466; 414/722, 727, 686

[56] References Cited

U.S. PATENT DOCUMENTS

| | | | |
|---|---|---|---|
| 4,049,138 | 9/1977 | Soyland | 37/103 X |
| 4,639,183 | 1/1987 | Güthoff | 37/103 X |
| 4,679,336 | 7/1987 | Brocklebank et al. | 37/103 |
| 4,746,264 | 5/1988 | Kishi et al. | 37/103 X |
| 4,776,750 | 10/1988 | Griswold, Jr. et al. | 37/103 X |
| 4,848,010 | 7/1989 | Zimmerman | 37/103 |
| 4,906,161 | 3/1990 | Weyer | 37/103 X |

FOREIGN PATENT DOCUMENTS 3932555 4/1991 Fed. Rep. of Germany .

*Primary Examiner*—Randolph A. Reese
*Assistant Examiner*—J. Russell McBee
*Attorney, Agent, or Firm*—Shlesinger, Arkwright & Garvey

[57] ABSTRACT

A backhoe-loader with a undercarriage resting on wheels and comprising at its front end a loader structure with a loader arm and a loading bucket and at the other end a superstructure revolving 360°, a driver cab is mounted to one side of the superstructure and on the other side next to the driver cab there are provided power units and a mounting pad pivotable about a vertical shaft for the horizontal pivot shaft of an excavator boom. The boom is positionable in a raised state with the dipper arm collapsed and the implement in a forward-pointing rest position above the undercarriage and outside the field of view of the driver cab. A front mudguard is present in front of the mounting pad and functions as a rest for the implement, the loader structure is mounted asymmetrically relatively to the longitudinal center axis of the undercarriage on the cab side of the undercarriage, and the rest for the implement on the front mudguard is widened toward the middle of the undercarriage.

18 Claims, 4 Drawing Sheets

BACKHOE-LOADER

FIELD OF THE INVENTION

The present invention concerns a backhoe-loader with an undercarriage comprising at its front end a loader structure with loader arm and loading bucket and at the other end a superstructure revolving by 360°, a driver cab is provided on one side and on the other, next to the driver cab, power units and a boom-mounting pad pivotable about a vertical shaft. In the raised state with the bucket arm and implement collapsed, the boom assumes a forward rest position for road travel which is laterally outside the field of view of the driver cab, with a front mudguard mounted in front of the mounting pad serving as rest for the implement.

BACKGROUND OF THE INVENTION

A backhoe-loader of the above kind is known from German Offenlegungsschrift 39 32 555, where the corresponding revolving superstructure is combined with a conventional loader at the front of the undercarriage on a mobile excavator. When excavating, the superstructure together with the boom assembly is pivoted rearward so that depending upon the superstructure's angle of rotation, excavation can proceed either in the extension of the longitudinal center axis of the undercarriage or in a lateral offset from it. Moreover excavation on the side is possible. When loading and when traveling on roadways, the superstructure together with the boom resting to the side of the driver cabin remain pivoted forward in the rest position providing the driver cab an unobstructed viewing of the loading bucket since the raised boom and the downward collapsed bucket arm remain sideways outside the field of view. The implement is seated on the mudguard laterally opposite the driver cab.

When in the rest position and pivoted forward, the boom assembly of prior art equipment, causes the implement to project beyond the lateral limits of the vehicle. Because safety regulations demand that during roadway travel no component may project beyond the lateral vehicle limits, substantially wide implements must be removed from the bucket arm and transported separately. This required assembly and dis-assembly of the implement that, even when using quick-disconnect means, is cumbersome and time-consuming. Moreover special care is required to pivot the boom assembly into the rest position, to prevent the implement from hitting the loader structure, and to remain inside the lateral limits of the vehicle.

OBJECTS AND SUMMARY OF THE INVENTION

The object of the invention is to improve the prior art backhoe-loader to the extent that it shall be possible to speedily move the superstructure with the boom assembly into a new position, from excavating work to loading or roadway travel, with dismantling or inverting the excavator or loading part and through simple control actuations in the absence of special attention.

The solution provided by the present invention is characterized as follows:

(a) the loader structure is mounted predominantly o the cab side of the undercarriage in asymmetric manner relative to the chassis center longitudinal axis, (b) the rest for the implement on the from mudguard is widened inward toward the center of the undercarriage, and (c) the rest is limited by a vertical protective wall o the side near the loader structure, the protective wall where called for forming part of the loader structure.

Compared to the state of the prior art, this design allows the driver/operator to pass rapidly and in a problem-free manner from excavating to loading to roadway travel, without the need for first disassembling a backhoe bucket and without the view of the bucket loader being hampered. The movable excavator portion of the vehicle consisting of the superstructure and boom assembly comprises side-shifting equipment important during eccentric excavations, and during loading or roadway travel remains sufficiently far back on the vehicle chassis to not degrade the clear view of the entire width of the loading bucket or the street in front of it.

The driver can achieve the rest position of the boom assembly in a very simple manner by aligning the longitudinal center axis of the superstructure with that of the undercarriage or the direction of the driver cab with that of the vehicle chassis, and pivoting the boom assembly when the boom is upward about the vertical axis of the mounting pad until the implement rests against the vertical protective wall present laterally at the loader structure. The vertical protective wall effectively prevents damage to the loader structure. Pivoting the boom assembly about the axis of the mounting pad is not required when the boom is in the longitudinal direction of the superstructure due to previously carried out excavations. In that case, or when the boom is slightly oblique, the rest provided on the mudguard is sufficiently large to receive most of the conventional excavation implements.

The present invention also defines a design wherein the common plane of rotation of the boom assembly in the rest position is approximately parallel to the longitudinal center axis of the undercarriage. Because of the lateral offset of the perpendicular axis of rotation of the mounting pad, the implement is assured in all cases of finding adequate space on the widened rest, even when the boom is slightly askew.

The present invention also relates to a hoisting frame of the loader laterally offset from the longitudinal center axis of the undercarriage which can be symmetrically linked to the loading bucket so as to advantageously spread and transmit the forces at play so that the reciprocating actuator as well as the shovel dump jack transmit centrally their reaction forces into the vehicle chassis.

The present invention also relates to the design of the angled frame portion of the loading crane. Symmetrical coupling of the actuation frame to the loading bucket is possible by means of an angle made up of simple components. When the angle for one frame side is present, an especially narrow loader structure will be achieved together with a hoisting frame hookup and symmetrically widening toward the loading shovel.

The present invention further relates to a loader structure wholly mounted to the side of the longitudinal center axis of the undercarriage, the loader arm consisting of two laterally spaced beams supported in the loader structure and which are connected at the front end to a transverse pipe support symmetrically linked to the loading bucket. Consequently, this loader structure offset towards the cab side makes it possible to provide an especially wide rest for the implement while not requiring a reinforcing the loader arm. The hoisting frame consisting of the above mentioned beams may be replaced by a single arm for a laterally offset loader structure, the front end of the single arm being widened to one side for the symmetrical hookup to the loading bucket.

The preferred driver cab according to the present invention reduces the distance between the steering wheel and the front edge of the bucket and allows optimal view for the operator during loading or roadway travel. The rear offset of the mounting pad to the cab front side makes it possible to receive the collapsed boom assembly without degrading the operators view of the loading bucket.

A selectively actuated front-wheel steering rear-wheel steering or all-wheel steering provided by the present invention to allow optimal utilization of the vehicle. The front-steering being operational during roadway travel to prevent equipment from coming loose and damaging other traffic members. On the other hand, loading proceeds with rear steering for optimal efficiency.

A transverse sill at the front side of the rest according to the present invention obviates the need for clamping or lashing-down of the implement onto the rest to preclude undesired motion in the event the hydraulic jack should yield due to leakage while traveling. In another embodiment the transverse sill may be replaced by a transverse U-channel or the like.

BRIEF DESCRIPTION OF THE DRAWINGS

Illustrative embodiments of the backhoe-loader of the invention are discussed below in relation to the drawings.

DETAILED DESCRIPTION OF THE PREFERRED EMBODIMENT

In the preferred embodiment shown, a backhoe-loader rests on an undercarriage 10 mounted to ground wheels 16 of from axle 12 and rear axle 14. The front-and-rear axle ground wheels 16 illustrated with opposite steering angles in FIGS. 3 and 4 indicate that a selectively switched steering control (not shown) is provided. This arrangement allows all-wheel steering on narrow construction sites, in extreme cases the so-called crab-steering, during roadway travel steering of the wheels of the front axle 12 only, and when working with the front loader, steering only with the wheels of the rear axle 14.

Figure 1:
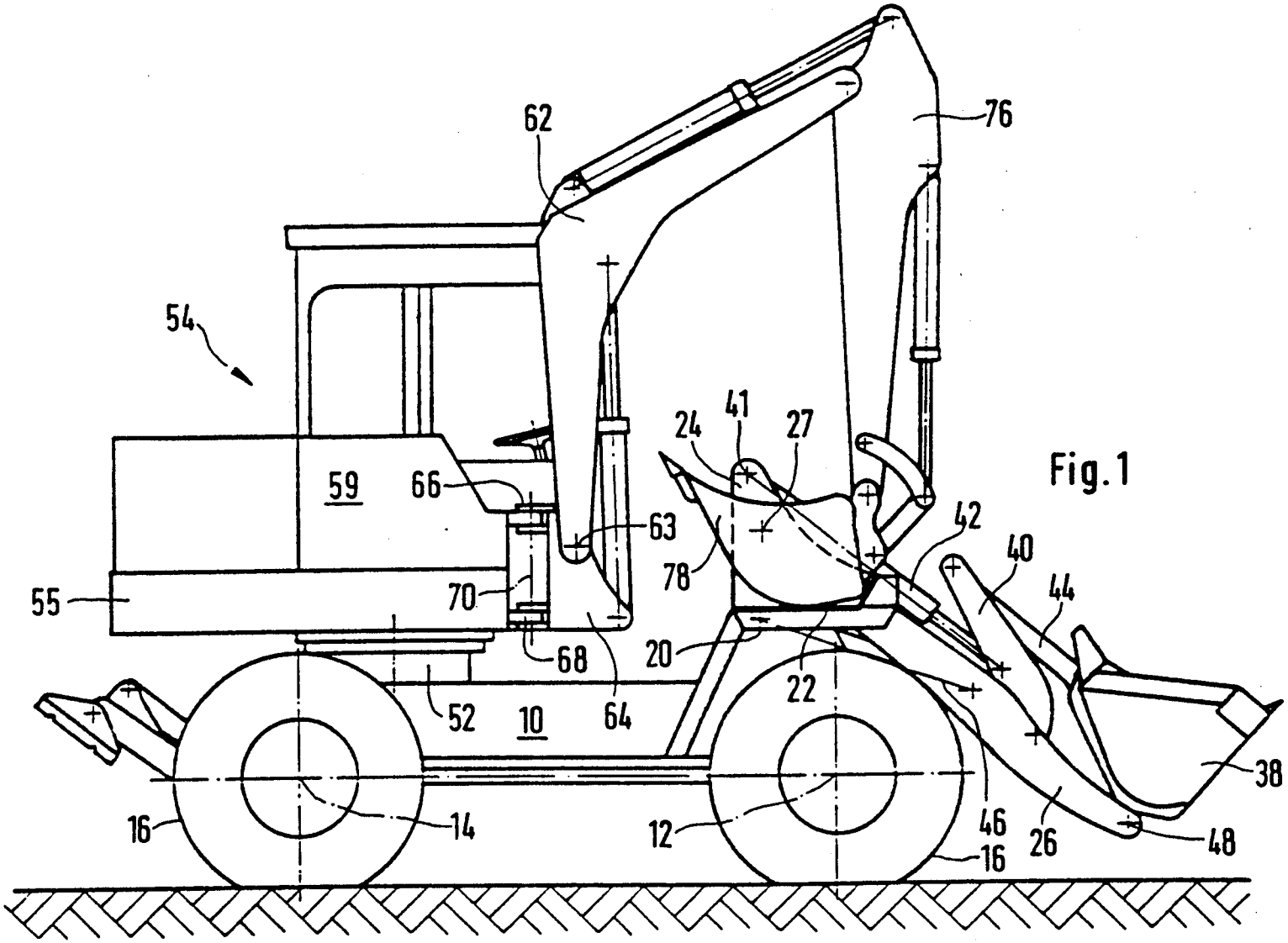
FIG. 1 is a side view of the backhoe-loader of the invention when traveling with the superstructure and boom assembly mounted in the direction of travel.
Figure 2:
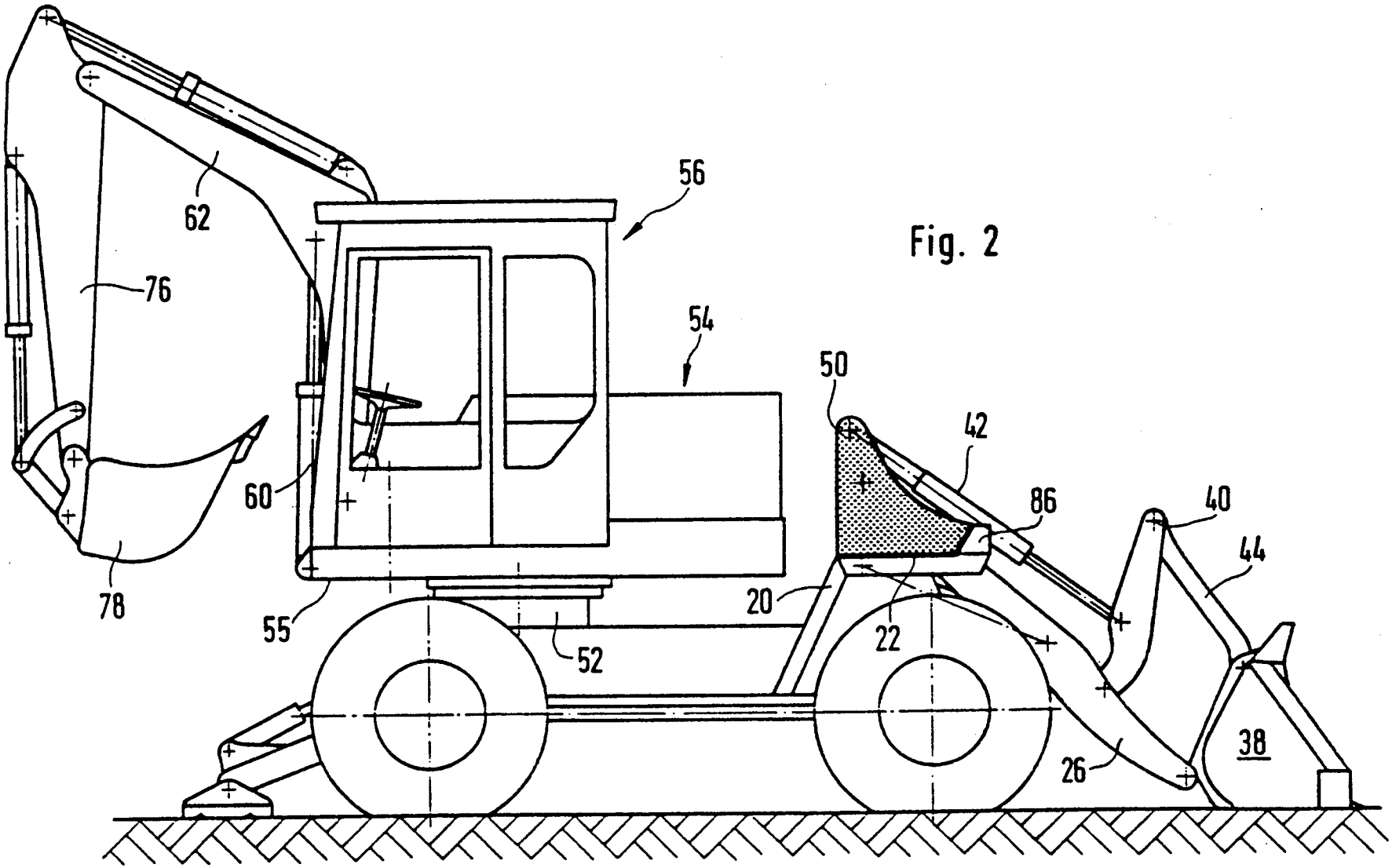
FIG. 2 is a side view of the backhoe-loader of FIG. 1 when excavating.

A loader structure consisting of vertical supports 24 is mounted at the front of the undercarriage 10, the rear end of a loader arm 26 pivotably rests on a horizontal shaft 27 located between the supports 24. An arm-actuating jack 46 shown in FIGS. 1 and 2 as an axis, links the loader structure and the loader arm 26. A loading bucket 38 pivoting about a horizontal shaft 48 is mounted to the front end of the loader arm 26 and is tipped in a known manner by a tipping jack 42 linked to a tipping arm 40 and to the loader structure at 41 and by means of a bar 43 extending between the tipping arm 40 and the loading bucket 38 between a forward, i.e. downward-open discharge or exploratory position as shown in FIG. 2 and an upward-open transport position as shown in FIG. 1.

A superstructure 54 revolving about a vertical shaft 53 rests for instance by means of a turntable 52 at the end of the undercarriage 10. The platform 55 of said superstructure supports a driver cab 56, a counterweight 58, a drive and hydraulic unit 59 and a boom assembly.

Figure 3:
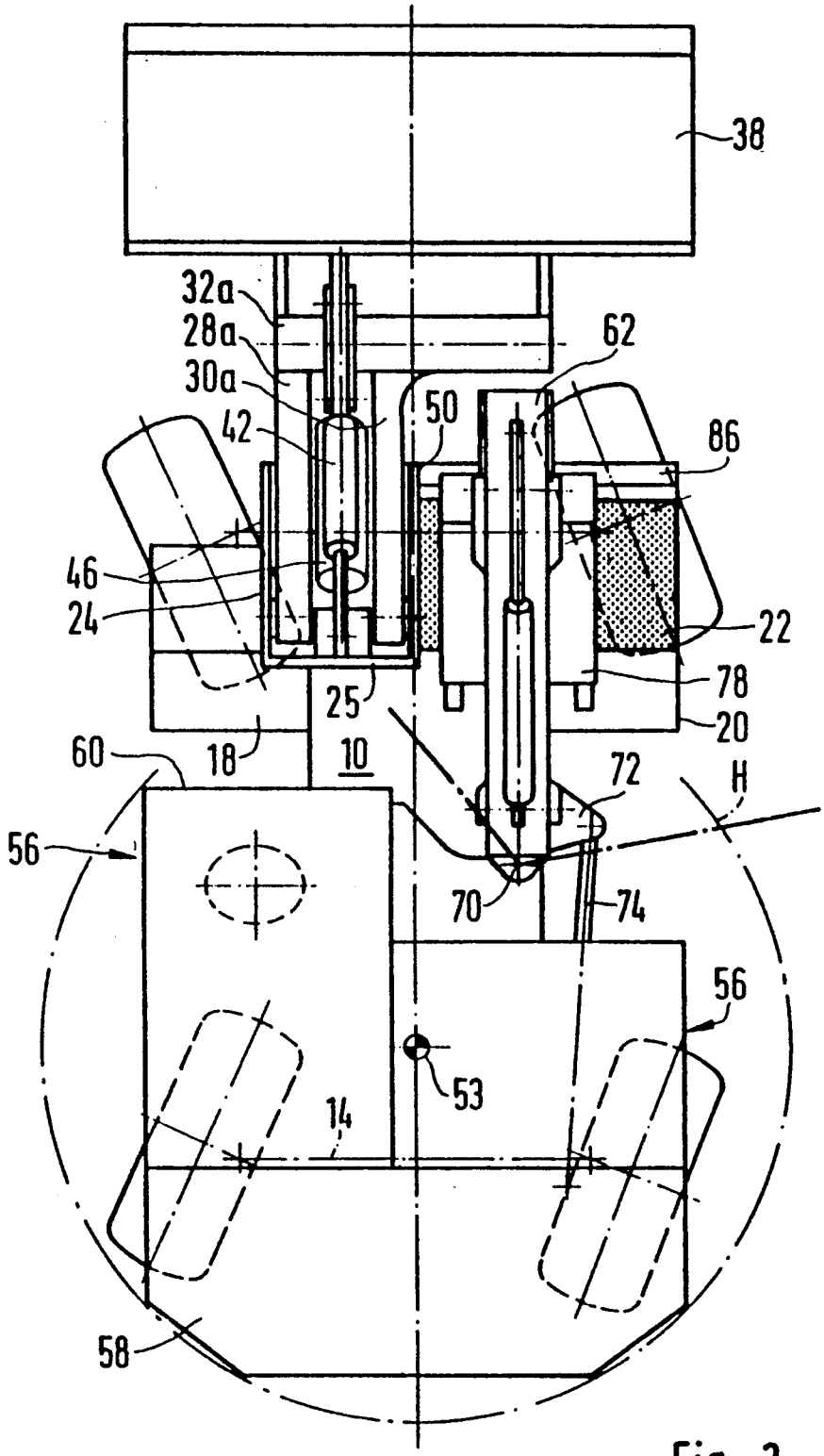
FIG. 3 is a top view relating to FIG. 1.
Figure 4:
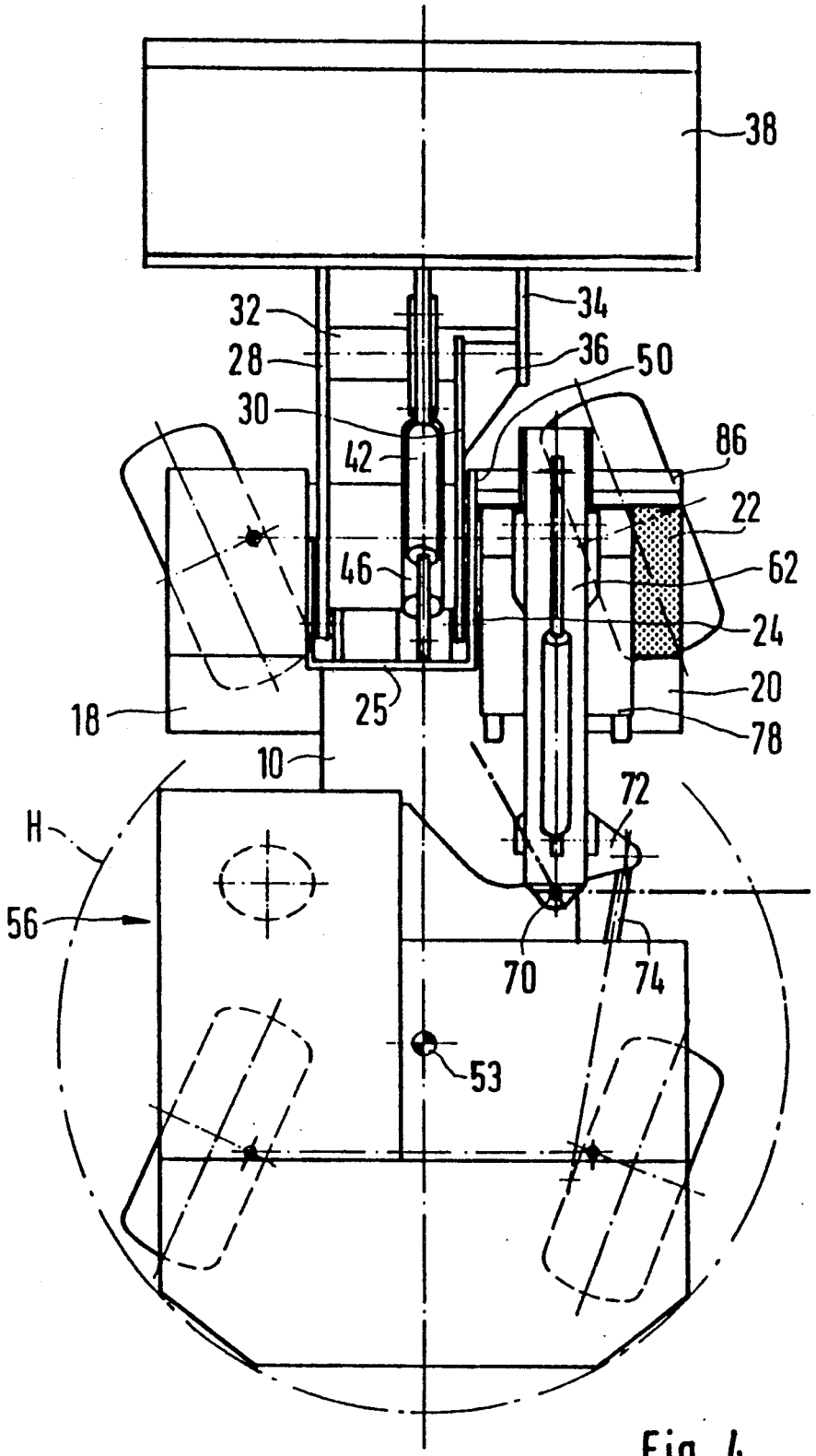
FIG. 4 is a top view of an altered embodiment of the backhoeloader similar to FIG. 3.

The backhoe boom 62 comprises a horizontal shaft 80 at mounting pad 64 which is pivotable about a vertical shaft 70 by means of shackles 66 on fittings 68 projecting from the superstructure. The mounting pad 64 can be pivoted about its shaft in either direction by about 120° or more as shown by FIGS. 3 and 4. For that purpose, the mounting pad 64 comprises a side attachment 72 serving as hookup for a pivot jack 74 the other of which end is linked to the superstructure. The pivot range of the mounting pad is indicated in dashed lines and may be widened using another pivot unit.

The dimensions of the superstructure, undercarriage and loading bucket are selected in such a way that, by their prescribed lateral limits, roadway travel shall be legal. For travel or loading operation, the superstructure is adjusted so that the cab from side is forward and as a result, the longitudinal center axis of the superstructure and undercarriage coincide. Inside the envelope circle H of the superstructure 54 rotatable 360° therein (and determined by the size of the counterweight 58), the driver cab 56 is mounted next to the longitudinal center axis and is advanced such that the driver has an unobstructed view off the loading bucket and of the street before it. The length of the superstructure platform 55 is reduced on the side of the drive cab 56. Accordingly, the pivot shaft 70 of the mounting pad 64 mounted in front of this platform zone is located laterally behind the cab front wall 60, and consequently enough space remains ahead of the mounting pad on the undercarriage 10 so that when the boom 62 is raised and the shovel arm 76 is collapsed downward, the collapsed implement 78 can be deposited in the rest position shown in FIGS. 1, 3 and 4 to the side and outside of the field of view of the driver cab.

As shown in the direction of advance, front left and right mudguards 18 and 20 respectively are mounted to undercarriage 10. The top side of the mudguard 20 is provided as shown by FIGS. 3 and 4 with a rest 22 extending from the longitudinal center axis of the undercarriage and may consist of a reinforced or supported plate or other suitable sturdy support.

The rest 22 extends to right loader structure support 24 and is bordered on the outside by a protective wall 50 (shown shaded in FIG. 2) or made integral therewith which functions to protect the loader structure against damage when the superstructure 54 together with the boom assembly or the boom assembly alone is pivoted into a rest position (shown in FIGS. 3 and 4) where the implement is deposited on the rest 22. A raised sill 86 is present at the front side of the rest 22 to secure the implement 78 during roadway travel so that it shall not slip forward and away from the rest in the event of leakage of the boom jacks which causes a lowering in locking effectiveness. Moreover the sill also can be provided at the other side of the rest.

As shown by FIG. 3, the rest 22 widens as far as the longitudinal center axis of the undercarriage, that is, as far as the vertical protective wall 50 which can be integral with the vertical support plate 24 of the loader structure. The two support plates 24 of the narrow loader structure mounted asymmetrically on the driver cab side are mutually connected or braced by a backwall 25. The loader arm 26 resting in the loader structure consists of pipe or box beams 28*a*, 30*a* of which the front ends are connected by a crossbeam 32*a*. The crossbeam 32*a* unilaterally extended by connections is hooked up symmetrically to the longitudinal center axis to a loading bucket 38. The tipping jack 52 and the rocker arm 46 as seen in the top view of FIG. 3 are located between and above the beams 28*a*, 30*a* of the loader arm.

Because of the comparatively wide rest 22 of FIG. 3, it is easy for the driver when switching between excavation to roadway travel or loading operation to seek a boom assembly rest position above the undercarriage and in which the implement will not project beyond the lateral vehicle bounds. In other words, the boom is not necessarily collapsed parallel to the longitudinal center axis of the undercarriage as shown in the Figure, but also may remain at a slight slant together with the digging scoop on the rest 22 toward either side.

In the embodiment of FIG. 4, the loader structure 24 is shifted toward the cab side of the undercarriage however the support 24 which is on the right hand side with respect to the direction of travel, and the protective plate 50 form an integral unit located on the right hand side of the rest 22 with respect to the longitudinal center axis. In this variation, the tipping jack 42 and the rocker arm jack 46 are supported at the middle of the undercarriage 10 and consequently the actuation and support forces occurring during operation of the loading bucket are symmetrically absorbed and spread.

The loader arm 26 formed as a hoisting frame consists of a left frame side 28 and a right frame side 30 which are jointed together by transverse bracings 32. The frame side 30 is angled, as a result of which the hoisting frame is symmetrically widened at the front end relative to the bucket width and is symmetrically hooked up to the loading bucket 38. A shorter front frame part 34 overlaps in the direction of the rocker arm with the longer rearward frame side 30 to which it is rigidly affixed by one or more fishplates 36. There are additional connections to the front transverse reinforcement 32. For this embodiment of the loader structure, the pivot shaft 70 of mounting pad 64 may be located a somewhat greater lateral distance from the longitudinal center axis of the superstructure than that shown in FIG. 3. This allows positioning of wide digging scoops on the rest while the boom assembly is in the forward pointing, collapsed rest position without thereby exceeding the lateral vehicle bounds.

Even though the lateral pivotability of the boom or the pivotable mounting pad increases the applicability of the mobile excavator, for instance to make laterally offset trenches, the advantages resulting from the rest widened in the manner of the invention also can be for excavators lacking the feature of side pivoting booms. The boom arm divided into two may be replaced by other boom assembly forms.

Whole the invention has been disclosed as having a preferred design, it is understood that it is capable of further modifications, uses and/or adaptations of the invention following in general the principle of the invention and including such departures from the present disclosure as come within known or customary practice in the art to which the invention pertains, and as may be applied to the central features hereinbefore set forth, and fall within the scope of the invention of the limits of the appended claims.

I claim:

1. In a backhoe-loader having a mobile undercarriage adapted for movement over the ground; a superstructure having first and second sides, said superstructure pivotally supported on said undercarriage for rotation relative thereto about a vertical axis; a loader assembly mounted on said undercarriage for movement about a vertical plane, said loader assembly including a support frame pivotally supported at a first end to said undercarriage and at a second opposite end to a loader bucket; an operator cab mounted to said superstructure first side; a backhoe assembly mounted to a pivot means associated with said superstructure second side and adjacent said cab, said backhoe assembly including an extensible, articulating boom carrying an earthworking implement, said boom being positionable into a stored position whereby said boom and implement are positioned above said undercarriage and substantially out of the field of view of said cab; a rest means secured to said undercarriage and longitudinally aligned with said backhoe assembly, said rest means providing support for said implement when said boom is in the stored position, the improvement comprising:

a) said loader assembly is asymmetrically mounted to said undercarriage so that the central longitudinal axis of said support frame is substantially offset from the central longitudinal axis of said undercarriage towards said superstructure first side; and b) said rest means is widened towards the central longitudinal axis of said undercarriage.

2. A backhoe-loader as in claim 1 and wherein:

a) said rest means comprising a horizontal support positioned forward of said superstructure, said horizontal support extending substantially adjacent to said support frame.

3. A backhoe-loader as in claim 2 and further comprising:

a) a vertical protective wall extending between said horizontal support and said support frame to limit lateral movement of said implement when said boom is positioned in the rest position.

4. A backhoe-loader as in claim 3 and wherein:

a) said horizontal support including sill means upwardly extending therefrom for restricting forward movement of said implement while supported by said rest means.

5. A backhoe-loader as in claim 1 and wherein:

a) said operator cab extending forward of said backhoe assembly pivot.

6. A backhoe-loader as in claim 1 and wherein:

a) said support frame having a generally L-shaped configuration whereby said pivotally supported first end is coaxial with the central longitudinal axis of said support frame and said second opposite end extends transverse thereto.

7. A backhoe-loader as in claim 6 and further comprising:

a) loader actuation means comprising a rocker arm jack and a bucket tipping jack disposed within said support frame first end and extending from said undercarriage to said loader bucket.

8. A backhoe-loader as in claim 7 and wherein:

a) said loader actuation means is aligned in a vertical plane with the central longitudinal axis of said undercarriage.

9. A backhoe-loader as in claim 7 and wherein:

a) said loader actuation means is laterally offset from the central longitudinal axis of said undercarriage towards said superstructure first side.

10. A backhoe-loader as in claim 1 and wherein:

a) said undercarriage including a front axle with wheels to provide movement of said backhoe-loader; and b) said rest means comprising a mudguard disposed over at least one of said wheels.

11. An earthworking machine comprising:

a) a mobile undercarriage adapted for movement over the ground, said undercarriage having a central longitudinal axis;

b) a superstructure having first and second sides, said superstructure pivotally supported on said undercarriage for rotation relative thereto about a vertical axis;

c) a loader assembly operable in a vertical plane, said loader assembly including a support frame having a central longitudinal axis, said loader assembly asymmetrically mounted to said undercarriage so that the central longitudinal axis of said support frame is substantially offset from the central longitudinal axis of said undercarriage towards said superstructure first side;

d) a backhoe assembly mounted to a pivot means associated with said superstructure second side and adjacent said cab, said backhoe assembly including an extensible, articulating boom carrying an earthworking implement, said boom being personable into a stored position so that said boom and implement are positioned above said undercarriage and substantially out of the field of view of said cab; and e) rest means secured to said undercarriage and longitudinally aligned forward of said backhoe assembly, said rest means providing a storage area for said implement when said boom is in the stored position.

12. An earthworking machine as set forth in claim 11 and wherein:

a) said support frame having a first end pivotally secured to said undercarriage, a second opposite end and a loader bucket attached to said second opposite end.

13. An earthworking machine as in claim 12 and wherein:

a) said support frame having a generally L-shaped configuration whereby said pivotally supported first end is coaxial with the central longitudinal axis of said support frame and said second opposite end extends transverse thereto.

14. An earthworking machine as set forth in claim 13 and further comprising:

a) loader actuation means comprising a rocker arm jack and a bucket tipping jack disposed within said support frame first end and extending from said undercarriage to said loader bucket.

15. An earthworking machine as set forth in claim 14 and wherein:

a) said loader actuation means is aligned in a vertical plane to the central longitudinal axis of said undercarriage.

16. An earthworking machine as set forth in claim 14 and wherein:

a) said loader actuation means is laterally offset from the central longitudinal axis of said undercarriage toward said superstructure first side.

17. An earthworking machine as set forth in claim 11 and wherein:

a) said rest means comprising a horizontal support secured to said undercarriage and positioned forward of said superstructure second side, said horizontal support extending substantially adjacent to said support frame.

18. An earthworking machine as set forth in claim 11 and further comprising:

a) a vertical protective wall extending between said horizontal support and said support frame to limit the lateral movement of said implement when in the rest position.

* * * * *